US008905523B2

(12) United States Patent
Nagatoya et al.

(10) Patent No.: US 8,905,523 B2
(45) Date of Patent: Dec. 9, 2014

(54) LIQUID EJECTING HEAD AND LIQUID EJECTING APPARATUS

(71) Applicant: Seiko Epson Corporation, Tokyo (JP)

(72) Inventors: Satoshi Nagatoya, Azumino (JP); Nobuhiro Naito, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/141,086

(22) Filed: Dec. 26, 2013

(65) Prior Publication Data

US 2014/0184706 A1 Jul. 3, 2014

(30) Foreign Application Priority Data

Dec. 27, 2012 (JP) ..... 2012-284507

(51) Int. Cl.

| | |
|---|---|
| ***B41J 2/045*** | (2006.01) |
| ***B41J 2/05*** | (2006.01) |
| ***B41J 2/14*** | (2006.01) |
| ***B41J 2/16*** | (2006.01) |

(52) U.S. Cl.

CPC ..... *B41J 2/14233* (2013.01); *B41J 2/1606* (2013.01); *B41J 2/161* (2013.01); *B41J 2/1642* (2013.01); *B41J 2/1646* (2013.01)

USPC ..... 347/70; 347/64; 347/65

(58) Field of Classification Search

None

See application file for complete search history.

(56) References Cited

U.S. PATENT DOCUMENTS

| | | | | |
|---|---|---|---|---|
| 7,686,421 | B2 * | 3/2010 | Yasoshima et al. | 347/45 |
| 2012/0182360 | A1 | 7/2012 | Ito et al. | |

FOREIGN PATENT DOCUMENTS

| | | |
|---|---|---|
| JP | 2009-083140 | 4/2009 |
| JP | 2011-088369 | 5/2011 |
| JP | 2012-143981 | 8/2012 |

* cited by examiner

*Primary Examiner* — Geoffrey Mruk

(74) *Attorney, Agent, or Firm* — Workman Nydegger

(57) ABSTRACT

According to a liquid ejecting head, it is possible to suppress erosion of a vibrating plate by liquid, suppress generation of variation in a vibrating property, and realize a thin head. The liquid ejecting head includes a flow path formation substrate on which a pressure generation chamber communicating with nozzle openings for discharging liquid is provided, an elastic film which is provided on one surface side of the flow path formation substrate and seals the pressure generation chamber, and a piezoelectric actuator which is a pressure generation unit which is provided on the elastic film to deform the elastic film. A tantalum oxide film which is formed by atomic layer deposition is provided at least on an inner wall of the pressure generation chamber.

4 Claims, 4 Drawing Sheets

B-B'

→ X

LIQUID EJECTING HEAD AND LIQUID EJECTING APPARATUS

BACKGROUND

1. Technical Field

The present invention relates to a liquid ejecting head which ejects liquid from nozzle openings and a liquid ejecting apparatus, particularly to an inkjet type recording head which ejects ink as liquid and an ink jet type recording apparatus.

2. Related Art

An ink jet type recording head which is an example of the liquid ejecting head, for example, includes a piezoelectric actuator which is a piezoelectric element on one surface side of a flow path formation substrate on which a pressure generation chamber which communicates with nozzle openings is provided, and ejects ink droplets from nozzles in such a manner that a vibrating plate is deformed due to the driving of the piezoelectric actuator and a change in pressure occurs in the pressure generation chamber.

Herein, there is a proposal of a vibrating plate containing silicon oxide or zirconium oxide on the flow path formation substrate side (for example, see JP-A-2009-83140 and JP-A-2011-88369).

In addition, there is proposed that a protection film having resistance to liquid of a material such as tantalum oxide be provided on an inner wall of a flow path of the pressure generation chamber or the like, for preventing erosion of the flow path formation substrate or the vibrating plate due to the ink in the flow path (for example, see JP-A-2012-143981).

However, in a case where the protection film of silicon oxide is provided on the flow path formation substrate side of the vibrating plate, if a pin hole or the like is formed on the protection film, there are problems that a vibrating property of the vibrating plate is negatively affected due to erosion (etching) of the vibrating plate by the ink (liquid) in the flow path, and there is a difficulty in stably deforming the vibrating plate.

Particularly, when realizing high density of the nozzle openings and a thin shape of the inkjet type recording head, it is necessary to make the protection film thin, and therefore a problem of the pin hole or the like tends to occur on the protection film.

The problems described above not only occur in the inkjet type recording head, but also occur in a liquid ejecting head which ejects liquid other than the ink.

SUMMARY

An advantage of some aspects of the invention is to provide a liquid ejecting head which can suppress erosion of a vibrating plate caused by liquid, suppress generation of variation in a vibrating property, and realize a thin head, and a liquid ejecting apparatus.

An aspect of the invention is directed to a liquid ejecting head including: a flow path formation substrate on which a pressure generation chamber communicating with nozzle openings for discharging liquid is provided; a vibrating plate which is provided on one surface side of the flow path formation substrate and seals the pressure generation chamber; and a pressure generation unit which is provided on the vibrating plate to deform the vibrating plate, in which a tantalum oxide film which is formed by atomic layer deposition is provided at least on an inner wall of the pressure generation chamber.

According to the aspect, by providing the tantalum oxide film which is formed by atomic layer deposition at least on the inner wall of the pressure generation chamber, it is possible to increase film density of the tantalum oxide film to have a compact film, and accordingly, it is possible to suppress erosion of the inner wall of the pressure generation chamber by liquid, by the tantalum oxide film. Therefore, it is possible to suppress erosion of the vibrating plate partitioning the pressure generation chamber by liquid, by the tantalum oxide film, and to stabilize a vibrating property of the vibrating plate. Since the tantalum oxide film having a high resistance to liquid can be formed, the tantalum oxide film can be formed to be relatively thin, and accordingly, it is possible to suppress inhibition of displacement of the vibrating plate by the tantalum oxide film, improve the displacement property of the piezoelectric actuator, realize the thin piezoelectric actuator, and realize a thin liquid ejecting head.

It is preferable that the tantalum oxide film is formed with a thickness of equal to or greater than 0.3 Å and equal to or smaller than 50 nm. According to this configuration, the thin tantalum oxide film having a thickness of equal to or smaller than 50 nm can be easily formed by atomic layer deposition, and it is possible to reliably suppress erosion caused by liquid, by the tantalum oxide film having a thickness of equal to or greater than 0.3 Å.

Another aspect of the invention is directed to a liquid ejecting apparatus including the liquid ejecting head according to the aspect described above.

It is possible to stabilize a discharging property of liquid, and realize a miniaturized liquid ejecting apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the embodiments of the invention will be described in detail.

Embodiment 1

Figure 1:
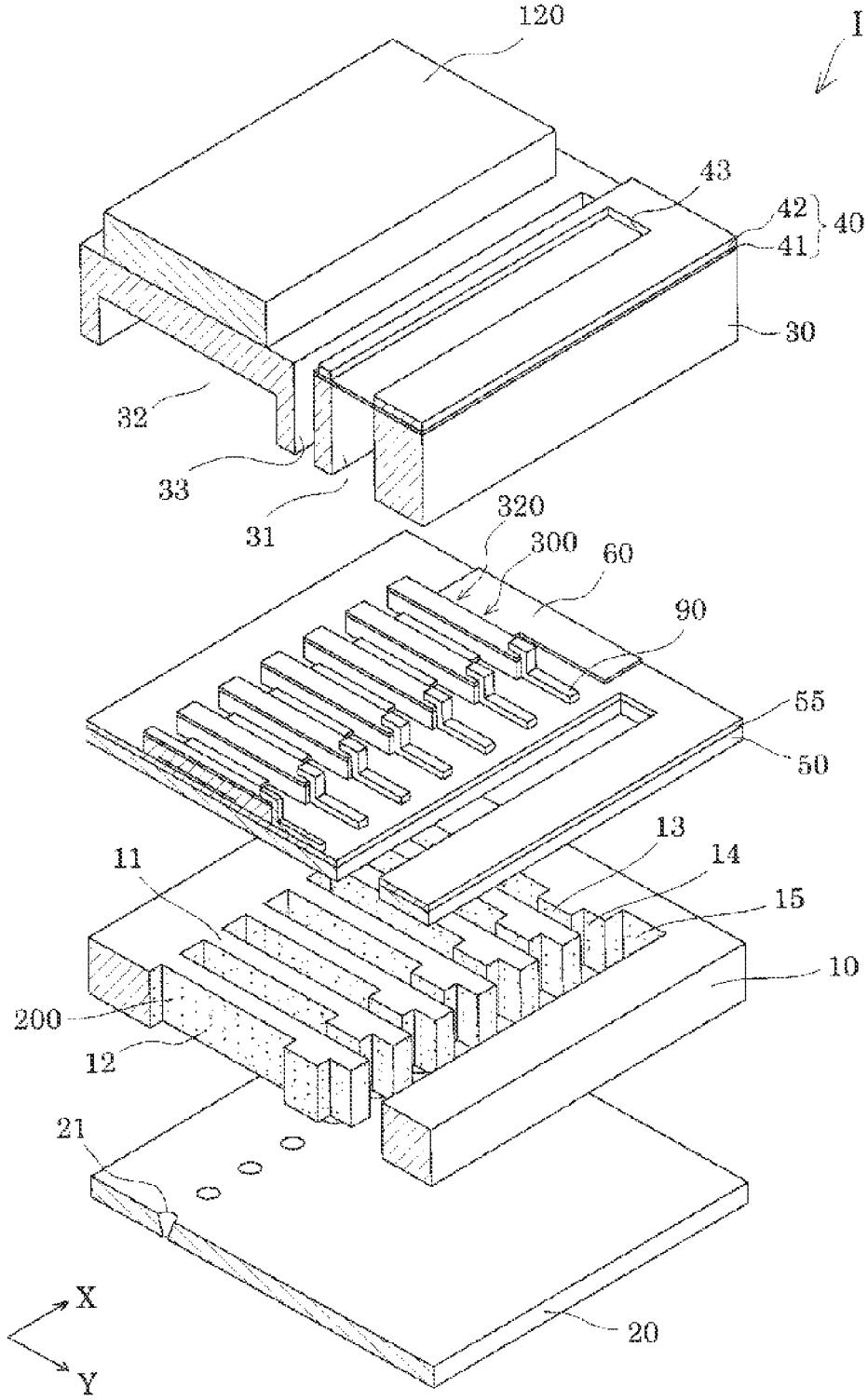
FIG. 1 is an exploded perspective view of a recording head according to Embodiment 1 of the invention.
Figure 2A:
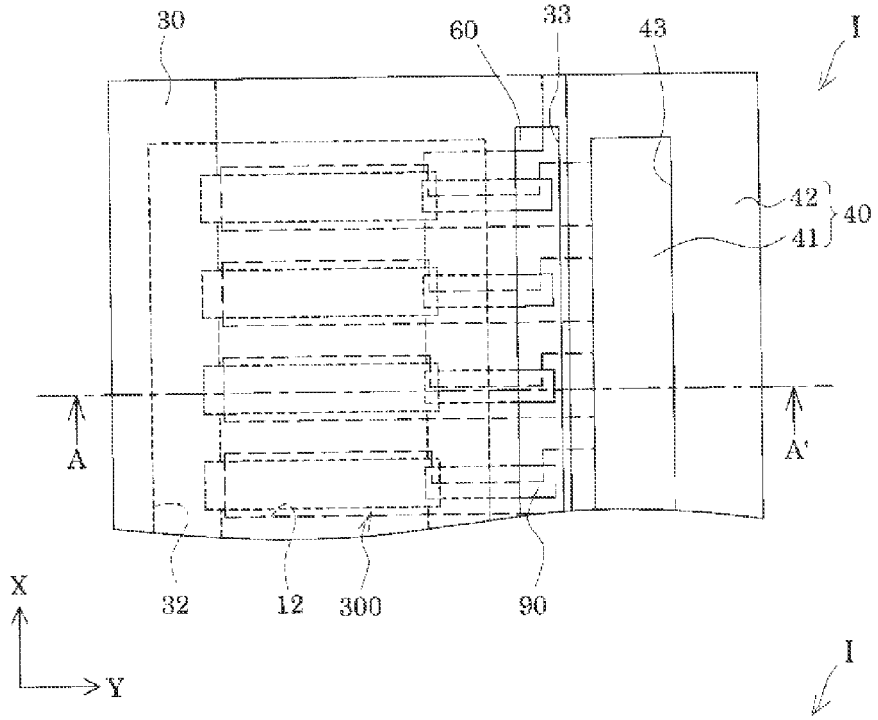
FIGS. 2A and 2B are a plan view and a cross-sectional view of a recording head according to Embodiment 1 of the invention.
Figure 2B:
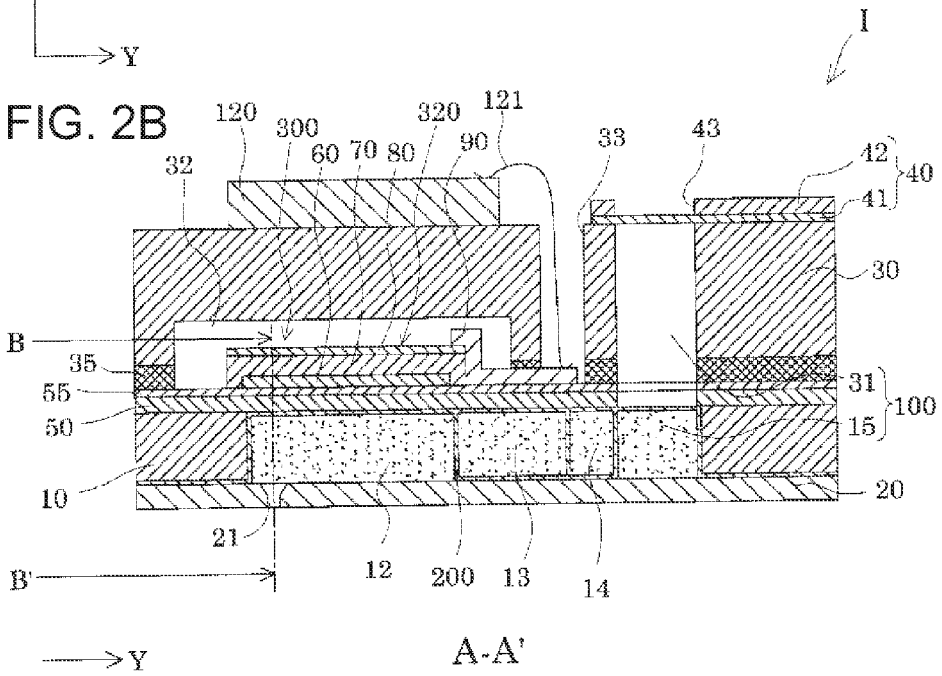
Figure 3:
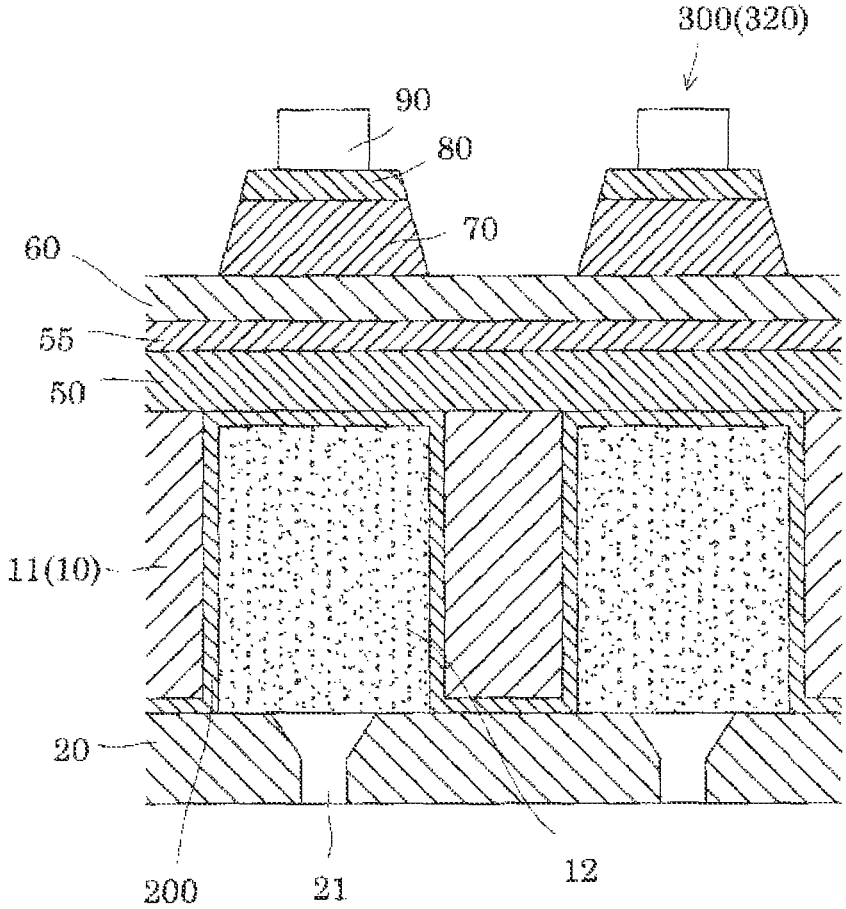
FIG. 3 is a cross-sectional view of a recording head according to Embodiment 1 of the invention.

FIG. 1 is an exploded perspective view of an inkjet type recording head which is an example of a liquid ejecting head according to Embodiment 1 of the invention, FIG. 2A is a plan view of FIG. 1 and FIG. 2B is a cross-sectional view taken along line A-A of FIG. 2A, and FIG. 3 is a cross-sectional view taken along line B-B of FIG. 2B.

As shown in the drawings, a flow path formation substrate 10 included in an ink jet type recording head I which is an example of a liquid ejecting head of the embodiment is formed of a silicon single-crystal substrate, for example in the embodiment. In the flow path formation substrate 10, a plurality of pressure generation chambers 12 which are partitioned by a plurality of partition walls 11 are provided in a line along a direction in which a plurality of nozzle openings 21 ejecting the same color of ink are provided in a line. Hereinafter, this direction is referred to as a direction in which the pressure generation chambers 12 are provided in a line or a first direction X. In addition, a direction orthogonal to the first direction X is referred to as a second direction Y.

Ink supply paths 13 and communication paths 14 are divided by the plurality of partition walls 11 on one end portion side of the flow path formation substrate 10 in a longitudinal direction of the pressure generation chamber 12, that is, on one end portion side in the second direction Y orthogonal to the first direction X. A communication portion 15 configuring a part of a manifold 100 which is a common ink chamber (liquid chamber) of each pressure generation chamber 12 is formed on the outer side of the communication path 14 (side opposite to the pressure generation chamber 12 in the second direction Y). That is, a liquid flow path formed with the pressure generation chamber 12, the ink supply path 13, the communication path 14, and the communication portion 15 is provided on the flow path formation substrate 10.

Herein, a protection film 200 which is a tantalum oxide film having tantalum oxide ($TaO_x$; amorphous) as a main component which is formed by atomic layer deposition is provided on an inner wall surface (inner surface) of the liquid flow path of the flow path formation substrate 10 formed with the pressure generation chamber 12, the ink supply path 13, the communication path 14, and the communication portion 15. In the embodiment, tantalum pentoxide ($Ta_2O_5$) is used as the protection film 200. To be formed by atomic layer deposition is to be formed as a film by an atomic layer deposition method (ALD).

As described above, the protection film 200 is formed with a tantalum oxide film, and accordingly it is possible to include the protection film 200 having an ink resistant property. The ink resistant property (liquid resistant property) herein is an etching resistant property with respect to alkaline or acidic ink (liquid).

In addition, by forming the protection film 200 by the atomic layer deposition method, the protection film 200 can be formed in a compact state with high film density. As described above, by forming the protection film 200 with high film density, the ink resistant property (liquid resistant property) of the protection film 200 can be improved. That is, the protection film 200 is formed with tantalum oxide to have the ink resistant property, and by forming the protection film with the atomic layer deposition method, the ink resistant property of the protection film 200 can be further improved. Accordingly, the ink resistant property of the protection film 200 is improved, and the erosion (etching) of the vibrating plate (elastic film 50) or the flow path formation substrate 10 by the ink (liquid) can be suppressed. Since it is possible to form the compact protection film 200 with the high ink resistant property, although the protection film 200 is formed with a thinner film thickness compared to the case of forming thereof by a CVD method or the like, a sufficient ink resistant property can be secured. Accordingly, the protection film 200 is formed with a relatively thin film thickness, and it is possible to suppress inhibition of displacement of the vibrating plate which will be specifically described later by the protection film 200, and accordingly it is possible to suppress a decrease in a displacement amount of the vibrating plate. In addition, since it is possible to suppress erosion of the vibrating plate by the ink, it is possible to suppress the generation of variation in the displacement property of the vibrating plate, and accordingly it is possible to deform the vibrating plate with a stable displacement property.

By forming the protection film 200 by the atomic layer deposition method, the protection film 200 can be formed on the inner surface of the flow path of the flow path formation substrate 10 having concavities and convexities of the pressure generation chamber 12 or the like, that is, on the elastic film 50 or on the partition wall 11, with a substantially even film thickness. That is, after forming the elastic film 50 which is the vibrating plate or a piezoelectric actuator 300 which will be described later on one surface of the flow path formation substrate 10, the flow path of the pressure generation chamber 12 or the like is formed on the flow path formation substrate 10, and then the protection film 200 is formed by the atomic layer deposition method in the flow path of the pressure generation chamber 12 or the like. Accordingly, in a case where the protection film is formed by a method other than the atomic layer deposition method, for example, a sputtering method or a CVD method, it is difficult to form the protection film 200 to have an even thickness on the surface in different directions. In the embodiment, by forming the protection film 200 by the atomic layer deposition method, it is possible to form the film on the surface in different directions with an even film thickness, suppress generation of variation in a displacement property of the vibrating plate, and suppress erosion of the vibrating plate (elastic film 50) or the flow path formation substrate 10 by the ink due to a coverage problem of the protection film 200.

Since the film is formed to be even and compact (high film density) by the atomic layer deposition method, the thickness of the protection film 200 having tantalum oxide as a main component which is formed by the atomic layer deposition method is preferably in a range of 0.3 Å to 50 nm, and is more preferably in a range of 10 nm to 30 nm. In addition, $Ta_2O_5$ ($TaO_x$) is soluble in an alkali, but if the film density is high (approximately 7 g/cm$^2$), it is hardly soluble in an alkali, and since acid resistivity thereof has a property of not dissolving in a solution other than hydrogen fluoride, $Ta_2O_5$ is effective for the protection film with respect to a strongly alkaline solution or a strongly acidic solution. That is, it is possible to easily form the protection film 200 with a relatively thin thickness which is equal to or smaller than 50 nm with high precision, by the atomic layer deposition method. Since the protection film 200 which is formed by the atomic layer deposition method is formed with the high film density, a sufficient ink resistant property can be secured with a thickness of equal to or greater than 0.3 Å. In addition, if the protection film 200 is formed to be thicker than that, it is not preferable since a longer time is taken and cost increases for forming the film. If the protection film 200 is formed to be thinner than that, it is not preferable since there is a concern that an even film is not formed over the entirety.

As described above, by setting the thickness of the protection film 200 smaller, it is possible to suppress inhibition of displacement of the vibrating plate by the protection film 200 and to improve the displacement of the piezoelectric actuator 300 which will be specifically described later. In addition, since the thickness of the protection film 200 can be set smaller, even if the thickness of the flow path formation substrate 10 is made smaller, it is possible to secure capacity of the pressure generation chamber 12, and set the thickness of the piezoelectric actuator 300 smaller. Accordingly, it is possible to realize the thin ink jet type recording head I and high density of the nozzle openings 21.

A nozzle plate 20 which the nozzle openings 21 communicating with each pressure generation chamber 12 penetrate is bonded to one surface side of the flow path formation substrate 10, that is, a surface on which the liquid flow path of the pressure generation chamber 12 or the like is opened, with an adhesive, a thermal welding film, or the like. That is, the nozzle openings 21 are provided in a line on the nozzle plate 20 in the first direction X.

The elastic film 50 which is formed of a material containing silicon oxide ($SiO_2$) and an insulating film 55 which is formed of a material containing zirconium oxide ($ZrO_2$) on the elastic film 50 are formed on the other surface side of the flow path formation substrate 10. The liquid flow path of the pressure generation chamber 12 is formed by anisotropic etching of the flow path formation substrate 10 from one surface thereof (surface side bonded to the nozzle plate 20), the other surface of the liquid flow path of the pressure generation chamber 12 is partitioned by the elastic film 50, and the protection film 200 is formed on the pressure generation chamber 12 side of the elastic film 50 as described above.

The piezoelectric actuator 300 which is a pressure generation unit of the embodiment and is formed of a first electrode 60, a piezoelectric layer 70, and a second electrode is formed on the insulating film 55. Herein, the piezoelectric actuator 300 is a portion including the first electrode 60, the piezoelectric layer 70, and the second electrode 80. In general, any one electrode of the piezoelectric actuator 300 is set to a common electrode, and the other electrode and the piezoelectric layer 70 are patterned for each pressure generation chamber 12. Herein, a portion which is configured from any one patterned electrode and the piezoelectric layer 70 and on which piezoelectric strain is generated by applying voltage to both electrodes is called a piezoelectric active portion. In the embodiment, the first electrode 60 is set to a common electrode of the piezoelectric actuator 300 and the second electrode 80 is set to an individual electrode of the piezoelectric actuator 300, however there is no problem in the reverse case according to circumstances of a driving circuit or wiring. In the example described above, the elastic film 50, the insulating film 55, and the first electrode 60 operate as the vibrating plate, however this is not limited thereto, of course. For example, only the first electrode 60 may act as the vibrating plate without providing the elastic film 50 and the insulating film 55. In addition, the piezoelectric actuator 300 itself may substantially function as the vibrating plate. Further, when the first electrode 60 is directly provided on the flow path formation substrate 10, in the embodiment, since the protection film of tantalum oxide is formed on the surface of the first electrode 60 on the pressure generation chamber 12 side, the first electrode 60 and the ink are not electrically connected to each other and can be insulated from each other.

The piezoelectric layer 70 is formed of a piezoelectric material such as oxide having a polarized structure which is formed on the first electrode 60, and for example, can be formed of perovskite-type oxide shown as a general formula $ABO_3$. A can include lead, and B can include at least one of zirconium and titanium. B can further include niobium, for example. In detail, as the piezoelectric layer 70, for example, lead zirconate titanate ($Pb(Zr,Ti)O_3$: PZT), or lead zirconate titanate niobate ($Pb(Zr,Ti,Nb)O_3$: PZTNS) containing silicon can be used.

The piezoelectric layer 70 may be set to composite oxide having a perovskite structure containing a lead-free piezoelectric material which does not contain lead such as bismuth ferrate or bismuth manganate ferrate, and barium titanate or bismuth potassium titanate, for example.

In addition, a lead electrode 90 formed of, for example, gold (Au) which is extracted from the vicinity of the end portion of the ink supply path 13 side and is provided to extend to the upper portion of the insulating film 55, is connected to each second electrode 80 which is an individual electrode of the piezoelectric actuator 300.

A protection substrate 30 including a manifold portion 31 configuring at least a part of the manifold 100 is bonded to the upper portion of the flow path formation substrate 10 on which the piezoelectric actuator 300 is formed, that is, on the upper portions of the first electrode 60, the elastic film 50, the insulating film 55, and the lead electrode 90, with an adhesive 35. In the embodiment, the manifold portion 31 penetrates the protection substrate 30 in the thickness direction and is formed in the width direction of the pressure generation chamber 12, and communicates with the communication portion 15 of the flow path formation substrate 10 to configure the manifold 100 which is the common ink chamber of each pressure generation chamber 12. In addition, the communication portion 15 of the flow path formation substrate 10 may be divided into a plural portions for each pressure generation chamber 12, and only the manifold portion 31 may be set as a manifold. Further, only the pressure generation chamber 12 may be provided on the flow path formation substrate 10, and the ink supply path 13 communicating the manifold and each pressure generation chamber 12 may be provided on the elastic film 50 and the insulating film 55 interposed between the flow path formation substrate 10 and the protection substrate 30.

On the protection substrate 30, a piezoelectric actuator holding portion 32 having a space for not inhibiting the movement of the piezoelectric actuator 300 is provided in a region facing the piezoelectric actuator 300. The piezoelectric actuator holding portion 32 may have a space as long as it does not inhibit the movement of the piezoelectric actuator 300, and the space may be sealed or not sealed.

In addition, a penetration hole 33 which penetrates through the protection substrate 30 in the thickness direction is provided on the protection substrate 30. The vicinity of the end portion of the lead electrode 90 which is extracted from each piezoelectric actuator 300 is provided so as to be exposed in the penetration hole 33.

A driving circuit 120 which functions as a signal processing unit is fixed onto the protection substrate 30. As the driving circuit 120, a circuit board or a semiconductor integrated circuit (IC) can be used, for example. The driving circuit 120 and the lead electrode 90 are electrically connected to each other through a connection wire 121 formed of a conductive wire such as a bonding wire which is inserted through the penetration hole 33.

As the protection substrate 30, a material having substantially the same coefficient of thermal expansion as the flow path formation substrate 10, for example, glass, a ceramic material, or the like is preferably used, and in the embodiment, a silicon single-crystal substrate which is the same material as the flow path formation substrate 10 is used for formation thereof.

A compliance substrate 40 formed of a sealing film 41 and a fixed plate 42 is bonded onto the protection substrate 30. Herein, the sealing film 41 is formed of a flexible material having low rigidity, for example, polyphenylene sulfide (PPS) film, and one surface of the manifold portion 31 is sealed by the sealing film 41. In addition, the fixed plate 42 is formed with a hard material such as metal, for example, stainless steel (SUS). Since the region of the fixed plate 42 facing the manifold 100 is set to an opening portion 43 which is completely removed in the thickness direction, one surface of the manifold 100 is sealed only with the sealing film 41 having flexibility.

In the ink jet type recording head I of the embodiment, the ink is introduced from an ink introduction port which is connected to an external ink supply unit (not shown), and the inside from the manifold 100 to the nozzle opening 21 is filled with the ink. After that, voltage is applied between the first electrode 60 and the second electrode 80 corresponding to the pressure generation chamber 12 according to a recording signal from the driving circuit 120, and accordingly the elastic film 50, the insulating film 55, the first electrode 60, and the piezoelectric layer 70 are deformed. Therefore, the pressure in the pressure generation chamber 12 is increased, and ink droplets are discharged from the nozzle openings 21.

As described above, in the ink jet type recording head I of the embodiment, by providing the protection film 200 having tantalum oxide as a main component which is formed by the atomic layer deposition method in the flow path formation substrate 10, it is possible to suppress erosion of the vibrating plate (elastic film 50) or the partition walls 11 of the flow path formation substrate 10 by the ink. Accordingly, it is possible to suppress change in the displacement property of the vibrating plate, stabilize the displacement property of the vibrating plate, and stabilize the discharging property of the ink droplets.

By forming the protection film 200 by the atomic layer deposition method, it is possible to form the compact protection film 200 with high film density. Accordingly, it is possible to set the thickness of the protection film 200 to be relatively small, and it is possible to suppress inhibition of deformation of the vibrating plate (elastic film 50) by the protection film 200 and improve a displacement amount of the piezoelectric actuator 300. By setting the thickness of the protection film 200 small, it is possible to suppress inhibition of the deformation of the vibrating plate, and accordingly, it is possible to set the thickness of the piezoelectric layer 70 of the piezoelectric actuator 300 small, set the thickness of the flow path formation substrate 10 (depth of pressure generation chamber 12) small, realize the thin ink jet type recording head I, and realize high density of the nozzle openings 21.

Other Embodiment

Hereinabove, Embodiment 1 of the invention has been described, however the basic configuration of the invention is not limited thereto.

For example, in Embodiment 1 described above, the elastic film 50 formed of silicon oxide and the insulating film 55 formed of zirconium oxide are provided, however, it is not particularly limited thereto, and for example, a silicon nitride film, a polysilicon film, an organic film (polyimide or parylene), or the like may be used as the elastic film 50. In addition, as the insulating film 55, titanium oxide ($TiO_2$), aluminum oxide ($Al_2O_3$), hafnium oxide ($HfO_2$), magnesium oxide (MgO), lanthanum aluminate ($LaAlO_3$), or the like may be used. No matter which material is used in the elastic film 50, by providing the protection film 200, it is possible to suppress erosion by the ink.

In Embodiment 1 described above, the protection film 200 is provided on the inner wall surface (inner surface) of the pressure generation chamber 12, the ink supply path 13, the communication path 14, the communication portion 15 of the flow path formation substrate 10, however, it is not limited thereto, and the protection film 200 having tantalum oxide as a main component which is formed by the atomic layer deposition method may be formed at least on the inner wall surface of the pressure generation chamber 12. That is, the protection film 200 is mainly for suppressing erosion of the vibrating plate (elastic film 50) by the ink, and the region other than the pressure generation chamber 12 of the flow path formation substrate 10 may be protected by another protection film which is formed by a method different from the atomic layer deposition method for forming the protection film 200, such as a sputtering method or a CVD method. In addition, the region other than the pressure generation chamber 12 of the flow path formation substrate 10 may be protected by a material other than tantalum oxide. That is, in the embodiment, by protecting the vibrating plate (elastic film 50) by the protection film 200 having tantalum oxide as a main component which is formed by the atomic layer deposition method, the erosion of the vibrating plate is suppressed and the variation in the displacement property of the vibrating plate is suppressed. Although the partition walls 11 or the like of the flow path formation substrate 10 may be eroded due to a pin hole or the like formed on the protection film, the erosion does not spread to the flow path adjacent thereto and there is no negative effect.

In Embodiment 1 described above, the pressure generation unit which discharges ink droplets from the nozzle opening 21 has been described using the thin film type piezoelectric actuator 300, however, it is not particularly limited thereto, and a thick film type piezoelectric actuator which is formed by a method of attaching a green sheet or a longitudinal vibration type piezoelectric actuator in which a piezoelectric material and an electrode forming material are alternately laminated to each other and expand and contract in an axial direction, can be used, for example.

In Embodiment 1 described above, the pressure generation unit which discharges ink droplets from the nozzle opening 21 has been described using the piezoelectric actuator 300, however, it is not particularly limited thereto, and for example, a so-called electrostatic actuator which generates static electricity between the vibrating plate and the electrode, and deforms the vibrating plate by the static electricity to discharge the liquid droplets from the nozzle openings can be used.

Figure 4:
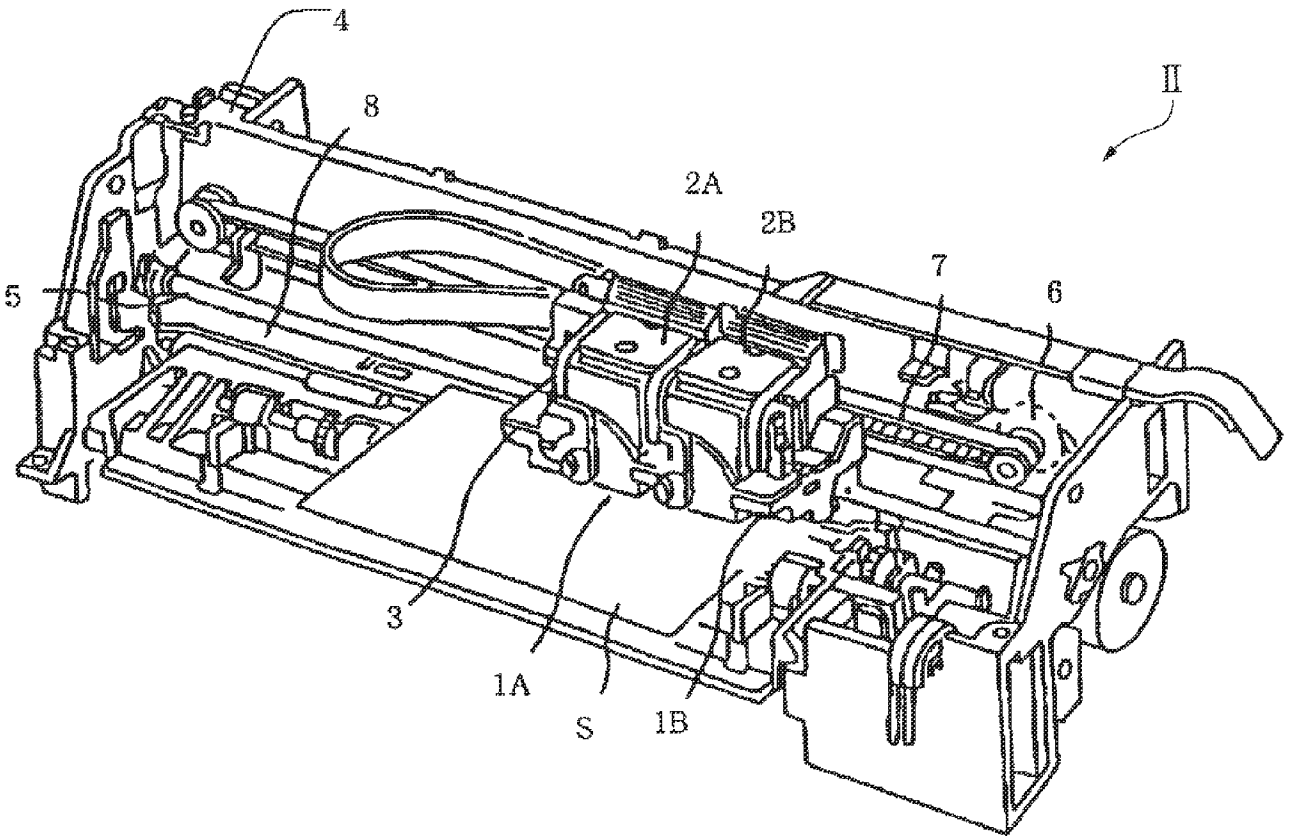
FIG. 4 is a view showing a schematic configuration of a recording apparatus according to one embodiment.

The ink jet type recording head of each embodiment configures a part of a recording head unit including an ink flow path communicating with the ink cartridge and the like, and is loaded on an ink jet type recording apparatus. FIG. 4 is a schematic view showing an example of the ink jet type recording apparatus (ink jet type recording apparatus II).

As shown in FIG. 4, cartridges 2A and 2B configuring the ink supply unit are detachably provided to recording head units 1A and 1B including the ink jet type recording head, and a carriage 3 on which the recording head units 1A and 1B are loaded, is movably provided, in an axial direction, on a carriage shaft 5 attached to an apparatus main body 4. For example, the recording head units 1A and 1B discharge a black ink composition and a color ink composition, respectively.

A driving force of a driving motor 6 is transferred to the carriage 3 through a plurality of gear teeth (not shown) and a timing belt 7, and accordingly the carriage 3 on which the recording head units 1A and 1B are loaded is moved along the carriage shaft 5. On the other hand, a platen 8 is provided on the apparatus main body 4 along the carriage shaft 5, and a recording sheet S which is a recording medium such as paper which is fed by a paper feeding roller (not shown) is wound on the platen 8 to be transported.

In the ink jet type recording apparatus II described above, the example in which the ink jet type recording head I (recording head units 1A and 1B) is loaded on the carriage 3 to move in a main scanning direction has been described, however it is not particularly limited thereto, and the invention can also be applied to a so-called line type recording apparatus in which the ink jet type recording head I is fixed and printing is performed by only moving the recording sheet S such as paper in an auxiliary scanning direction.

In the embodiments described above, the ink jet type recording head has been described as an example of the liquid ejecting head and the ink jet type recording apparatus has been described as an example of the liquid ejecting apparatus, however, the invention is for general liquid ejecting heads and liquid ejecting apparatuses in a broad sense, and can also be applied to a liquid ejecting head or a liquid ejecting apparatus which ejects liquid other than the ink. As the other liquid ejecting head, various recording heads used in an image recording apparatus such as a printer, a coloring material ejecting head used in manufacturing a color filter such as a liquid crystal display, an electrode material ejecting head used in electrode forming such as an organic EL display or a field emission display (FED), a bioorganic material ejecting head used in bio chip manufacturing, and the like can be exemplified, and the invention can also be applied to a liquid ejecting apparatus including such liquid ejecting heads.

The entire disclosure of Japanese Patent Application No. 2012-284507, filed Dec. 27, 2012 is expressly incorporated by reference herein.

What is claimed is:

1. A liquid ejecting head comprising:

a flow path formation substrate on which a pressure generation chamber communicating with nozzle openings for discharging liquid is provided;

a vibrating plate which is provided on one surface side of the flow path formation substrate and seals the pressure generation chamber;

a pressure generation unit which is provided on the vibrating plate to deform the vibrating plate; and a tantalum oxide film which is formed by atomic layer deposition and provided at least on an inner wall of the pressure generation chamber, wherein a thickness of the tantalum oxide film is greater than 0.3 Å and less than or equal to 30 nm.

2. The liquid ejecting head according to claim 1, wherein the tantalum oxide film has a density of approximately 7 $g/cm^2$.

3. A liquid ejecting apparatus comprising the liquid ejecting head according to claim 2.

4. A liquid ejecting apparatus comprising the liquid ejecting head according to claim 1.

* * * * *